US007909049B2

(12) United States Patent
Yang et al.

(10) Patent No.: US 7,909,049 B2
(45) Date of Patent: Mar. 22, 2011

(54) OPERATING MECHANISM FOR UMBRELLA

(76) Inventors: Chuan-Chin Yang, Chuanghua Hsien (TW); Chi-Sheng Huang, Sanchung (TW)

( * ) Notice: Subject to any disclaimer, the term of this patent is extended or adjusted under 35 U.S.C. 154(b) by 0 days.

(21) Appl. No.: 12/648,065

(22) Filed: Dec. 28, 2009

(65) Prior Publication Data

US 2010/0170545 A1 Jul. 8, 2010

(30) Foreign Application Priority Data

Jan. 6, 2009 (TW) ..... 98200118 U

(51) Int. Cl.
*A45B 25/14* (2006.01)

(52) U.S. Cl. ..... 135/20.3; 135/22

(58) Field of Classification Search ..... 135/22, 135/20.3
See application file for complete search history.

(56) References Cited

U.S. PATENT DOCUMENTS

| | | | | |
|---|---|---|---|---|
| 4,424,824 | A * | 1/1984 | Becher | 135/20.3 |
| 5,141,010 | A * | 8/1992 | Muller et al. | 135/20.3 |
| 5,213,122 | A * | 5/1993 | Grady, II | 135/20.3 |
| 5,291,908 | A * | 3/1994 | Grady, II | 135/22 |
| 5,386,842 | A * | 2/1995 | Becher | 135/20.3 |
| 6,543,464 | B1 * | 4/2003 | Grady, II | 135/22 |
| 7,562,666 | B2 * | 7/2009 | Chan | 135/20.3 |
| 2010/0012164 | A1 * | 1/2010 | Stoelinga | 135/20.3 |

* cited by examiner

*Primary Examiner* — David Dunn
*Assistant Examiner* — Noah Chandler Hawk
(74) *Attorney, Agent, or Firm* — Jackson IPG PLLC; Demian K. Jackson

(57) ABSTRACT

An operating mechanism used in an umbrella is disclosed to include a telescopic shaft, first and second screw nuts fixedly mounted in the telescopic shaft at different elevations, a third screw nut is fixedly mounted in the runner of the umbrella, a first screw rod threaded through the first screw nut, a second screw rod threaded through the second screw nut and axially slidably connected to and rotatable with the first screw rod, a third screw rod threaded through the third screw nut and axially slidably connected to and rotatable with the second screw rod, and a transmission mechanism connected to the first screw rod and operable to rotate the first screw rod.

7 Claims, 11 Drawing Sheets

OPERATING MECHANISM FOR UMBRELLA

BACKGROUND OF THE INVENTION

1. Field of the Invention

The present invention relates to umbrellas and more particularly, to an operating mechanism for umbrella, which uses screw rods and screw nuts to move the telescopic umbrella shaft between the extended position and the received position, thereby moving the runner to open or close the umbrella canopy.

2. Description of the Related Art

Many automatic umbrellas are commercially available. These conventional automatic umbrellas have drawbacks as follows:

1. When released the lock, the runner is suddenly forced by the spring force of the related spring member to push the umbrella stretchers against the umbrella ribs, opening the umbrella canopy in a rush. Sudden open of the umbrella canopy may injure other persons accidentally.
2. After the umbrella canopy is opened, the runner is not locked, and the umbrella canopy may be forced by a strong wind to collapse the umbrella stretchers and the umbrella ribs.
3. The spring member will start to deteriorate after a long use of the umbrella, affecting normal functioning of the umbrella.

SUMMARY OF THE INVENTION

The present invention has been accomplished under the circumstances in view. It is one object of the present invention to provide an operating mechanism for umbrella, which assures positive positioning and high safety when opening or closing the umbrella. It is another object of the present invention to provide an operating mechanism for umbrella, which is durable in use.

To achieve these and other objects of the present invention, an operating mechanism is used in an umbrella comprising a hub and rib assembly, a runner, a plurality of stretchers pivotally connected between the ribs of the hub and rib assembly and the runner, and a canopy stretched on the hub and rib assembly. The operating mechanism is operable to move the runner against the stretchers and to further force the ribs of the hub and rib assembly to open/close the canopy. The operating mechanism comprises a telescopic shaft, first and second screw nuts fixedly mounted in the telescopic shaft at different elevations, a third screw nut is fixedly mounted in the runner of the umbrella, a first screw rod threaded through the first screw nut, a second screw rod threaded through the second screw nut and axially slidably connected to and rotatable with the first screw rod, a third screw rod threaded through the third screw nut and axially slidably connected to and rotatable with the second screw rod, and a transmission mechanism connected to the first screw rod and operable to rotate the first screw rod.

Further, the transmission mechanism comprises a transmission gear set, and a drive member rotatable by a user to drive the transmission gear set, causing the transmission gear set to rotate the first, second and third screw rods and to further move the runner upwards or downwards.

In an alternate form of the present invention, a motor is provided for driving the transmission gear set to rotate the first, second and third screw rods

DETAILED DESCRIPTION OF THE INVENTION

Figure 1:
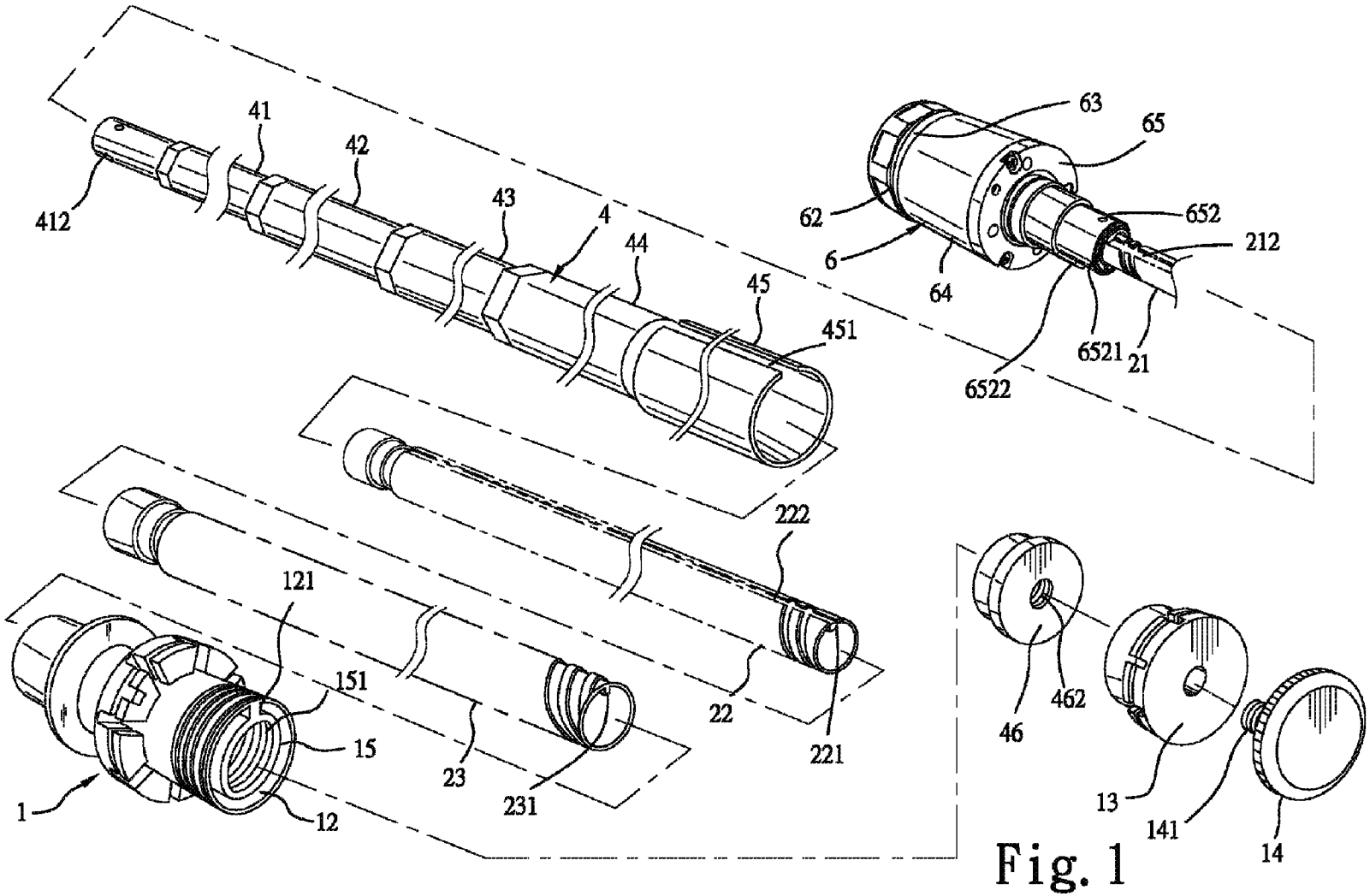
FIG. 1 is an exploded view of an operating mechanism for umbrella in accordance with a first embodiment of the present invention.
Figure 2:
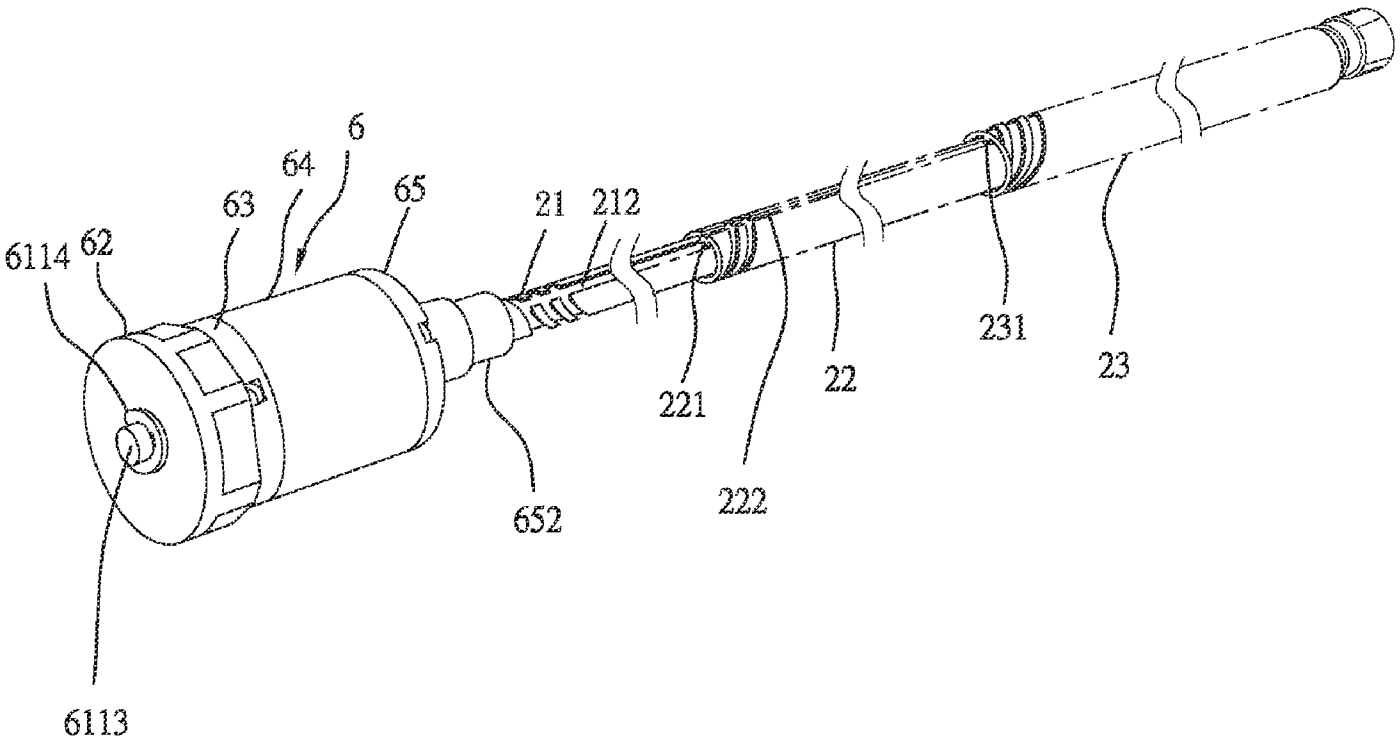
FIG. 2 is a schematic assembly view of the operating mechanism for umbrella in accordance with the first embodiment of the present invention.

Referring to FIGS. 1~8, an operating mechanism in accordance with a first embodiment is shown used in an umbrella comprising a hub and rib assembly 13, a runner 1, a plurality of stretchers 16 pivotally connected between the (ribs of the) hub and rib assembly 13 and the runner 1, and a canopy 10 stretched on the hub and rib assembly 13. When the runner 1 is moved upwards subject to the operation of the operating mechanism, the stretchers 16 are forced to move the hub and rib assembly in opening the canopy 10. On the contrary, when the runner 1 is moved downwards, the stretchers 16 are received together, causing the hub and rib assembly 13 to close the canopy 10.

The aforesaid operating mechanism comprises a plurality of hollow screw rods, i.e., the first screw rod 21, the second screw rod 22 and the third screw rod 23, a plurality of screw nuts, i.e., the first screw nut 31, the second screw nut 32 and the third screw nut 15, a telescopic shaft 4, and a transmission mechanism 6.

The first screw nut 31 and the second screw nut 32 are fixedly mounted inside the telescopic shaft 4 at different elevations. The third screw nut 15 is formed integral with or fixedly mounted in the inner diameter of the runner 1.

The first screw rod 21 is threaded through the first screw nut 31 and inserted into the second screw rod 22 (see FIG. 3), having a gear 211 fixedly located on its one end and meshed with the transmission mechanism 6 and a longitudinal sliding groove 212 for guiding axial movement of the longitudinal rib 221 the second screw rod 22 relative to the first screw rod 21. The second screw rod 22 is threaded through the second screw nut 32 (see FIG. 3), having a longitudinal sliding groove 222 (see FIG. 4) for guiding axial movement of the third screw rod 23 relative to the second screw rod 22. The third screw rod 23 is threaded through the inner thread 151 of the third screw nut 15 in the runner 1, having a longitudinal rib 231 axially slidably coupled to the longitudinal sliding groove 222 of the second screw rod 22.

The telescopic shaft 4 comprises a plurality of tubular shaft elements 41~45 that slide one inside another, a cap 46. The bottom tubular shaft element, i.e., the first tubular shaft element 41 is fixedly connected to the transmission mechanism 6. The aforesaid first screw nut 31 is fixedly mounted in the first tubular shaft element 41 and meshed with the first screw rod 21 (see FIG. 3). The aforesaid second screw nut 32 is fixedly mounted inside the top tubular shaft element, the fifth tubular shaft element 45 and meshed with the second screw rod 22. The fifth tubular shaft element 45 is inserted through the inner diameter 12 of the runner 1, having a longitudinal crevice 451, which receives a longitudinal rib 121 of the runner 1, and a top locating hole 452. The cap 46 is fastened to the top locating hole 452 of the top tubular shaft element 45 with a fastening device 453 for stopping the top end 232 of the third screw rod 23, having a top screw hole 462. Further, a holding down device 14 is attached to the top side of the canopy 10 to hold down the canopy 10 on the cap 46 and the hub and rib assembly 13, having a threaded shank 141 threaded into the top screw hole 462 of the cap 46 (see FIGS. 1 and 3).

The transmission mechanism 6 comprises a transmission gear set 61, a drive member 62, a housing 64 that houses the transmission gear set 61, a front cover 63 covered on one side of the housing 64, and a rear cover 65 covered on the other side of the housing 64. By means of rotating the drive member 62 clockwise or counter-clockwise, the transmission gear set 61 is driven to rotate the first screw rod 21 clockwise or counter-clockwise.

When the drive member 62 is rotated clockwise or counter-clockwise, the transmission gear set 61 is driven to rotate the first screw rod 21 clockwise or counter-clockwise, and the second screw rod 22 as well as the third screw rod 23 are rotated with the first screw rod 21, thereby causing the runner 1 to move upwards or downwards along the third screw rod 23 to open or close the canopy 10. During rotation of the first screw rod 21, second screw rod 22 and third screw rod 23 of the operating mechanism, the third tubular shaft element 43 and the fifth tubular shaft element 45 are respectively moved with the first screw nut 31 and the second screw nut 32 to extend out or receive the telescopic shaft 4.

Figure 5:
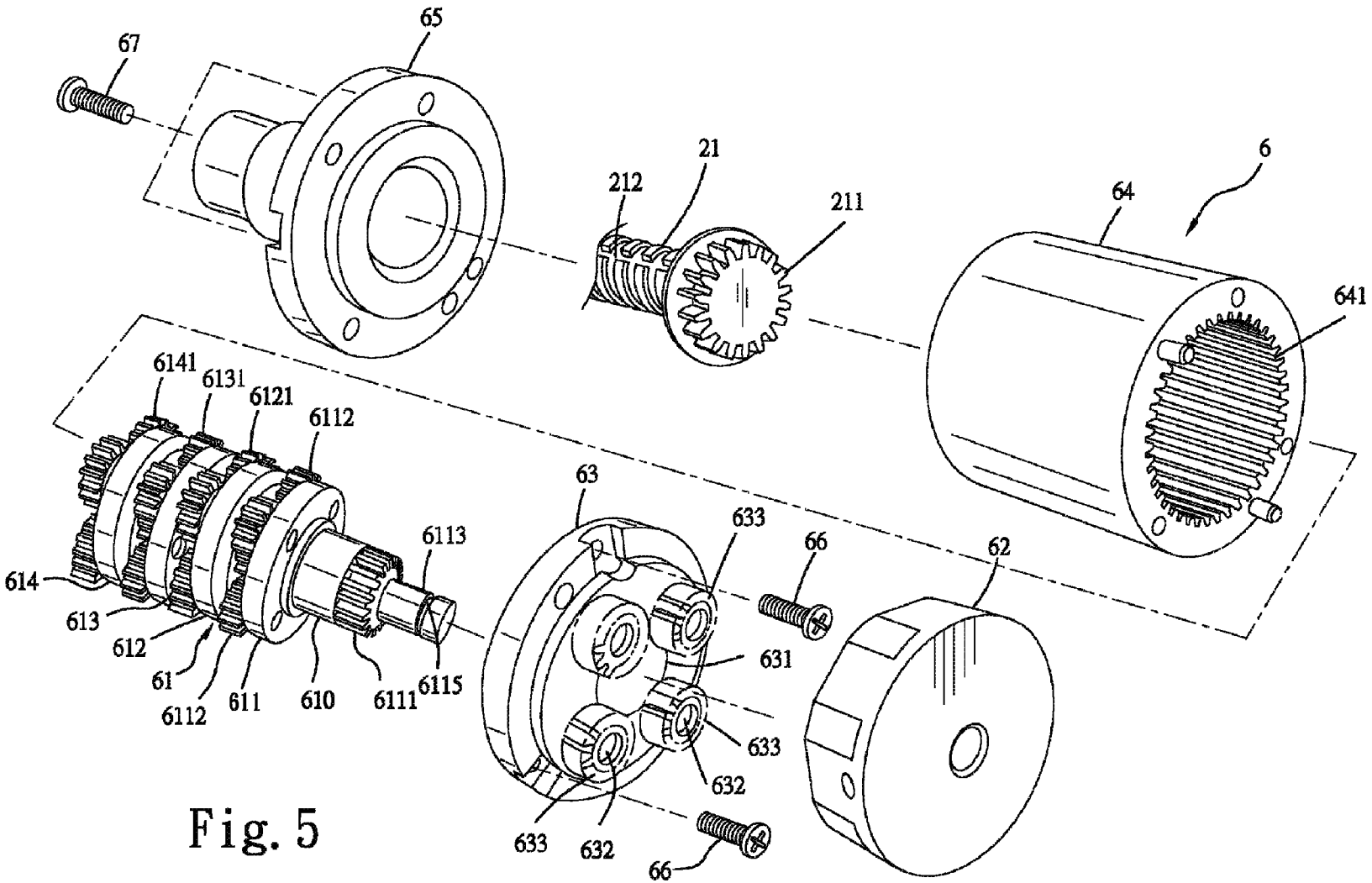
FIG. 5 is an exploded view of the transmission mechanism of the operating mechanism for umbrella in accordance with the first embodiment of the present invention.
Figure 6:
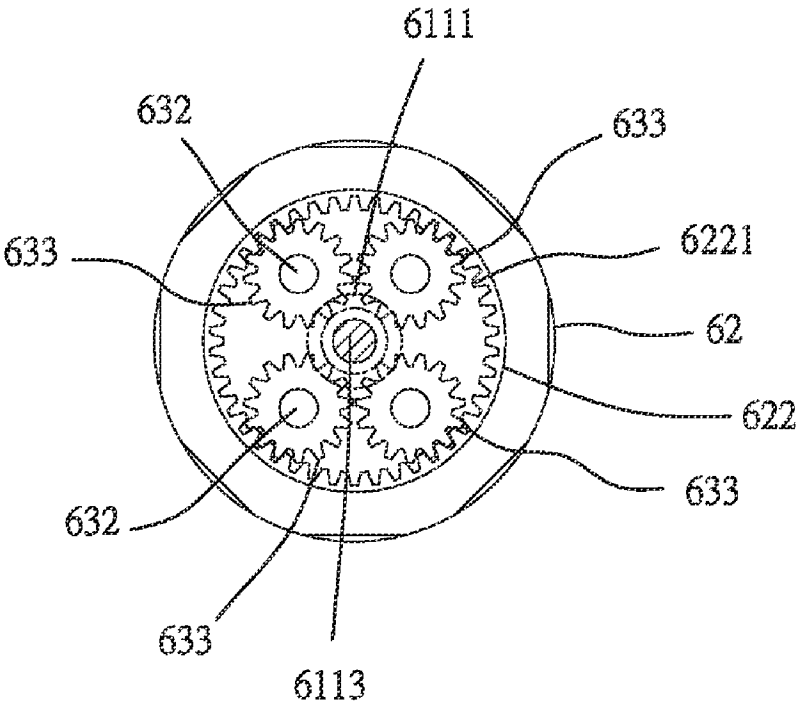
FIG. 6 is a cross sectional view of the transmission mechanism of the operating mechanism for umbrella in accordance with the first embodiment of the present invention.
Figure 7:
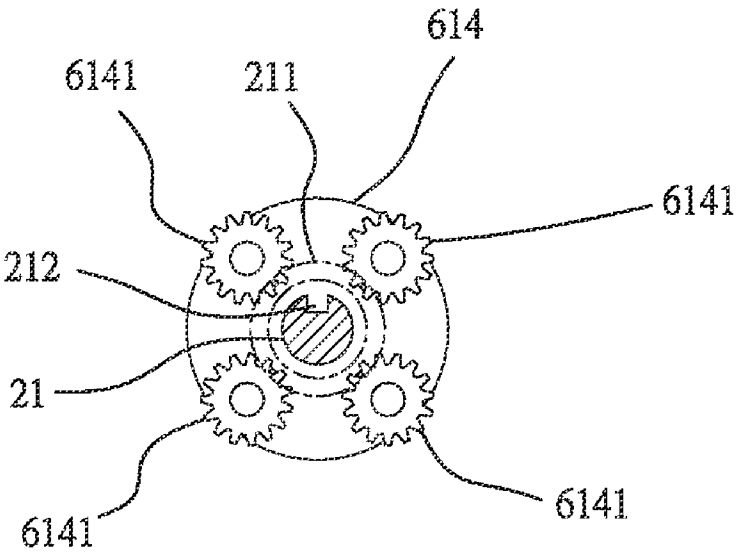
FIG. 7 is a cross sectional view of a part of the first embodiment of the present invention, showing the gear of the first screw rod meshed with the transmission gears of the of the last gear holder of the transmission gear set.
Figure 8:
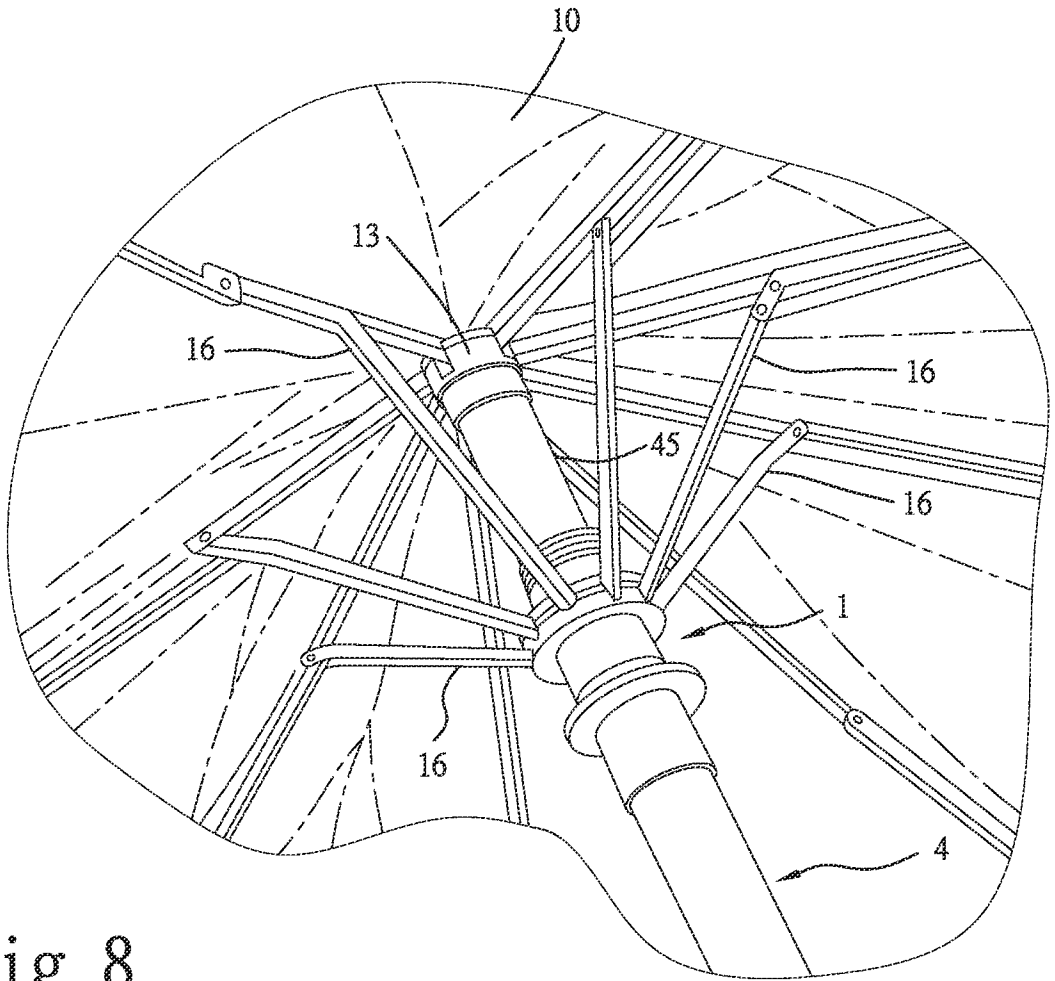
FIG. 8 is a schematic drawing of the present invention, showing the runner moved upwards and the stretchers extended outwards.

Further, as shown in FIGS. 5 and 6, the drive member 62 has a circular chamber 622 (see FIG. 6) and a plurality of teeth 6221 arranged around the inside wall of the circular chamber 622.

The housing 64 is a tubular member having a plurality of longitudinal teeth 641 arranged around the inside wall.

The front cover 63 is fixedly mounted on the front side of the housing 64 with screws 66, having a center axle hole 631 (see FIG. 5), a plurality of pivot pins 632 perpendicularly extended from the front side thereof and equiangularly spaced around the center axle hole 631, and a plurality of gears 633 respectively pivotally mounted on the pivot pins 632 and meshed with the teeth 6221 of the drive member 62.

The rear cover 65 is fixedly mounted on the rear side of the housing 64 with a screw 67, having an extension tube 652, an axial hole 6521 defined in the extension tube 652 for the passing of the first screw rod 21, and a locating block 6522 fastened to a retaining hole 412 of the bottom tubular shaft element 41 of the telescopic shaft 4.

The transmission gear set 61 comprises a plurality of gear holders 611~614 each supporting a plurality of transmission gears 6112, 6121, 6131 and 6141. The gears 6112, 6121, 6131 and 6141 are meshed with the longitudinal teeth 641 of the housing 64. The first gear holder 611 of the transmission gear set 61 further comprises an axle 610 pivotally coupled to the center axle hole 631 of the front cover 63, a driven gear 6111 fixedly mounted on the free end of the axle 610 and meshed with the gears 633 of the front cover 63, a front extension rod 6113 axially extended from the center of the driven gear 6111 and inserted through the drive member 62, and a retainer ring 6114 fastened to a locating groove 6115 around the periphery of the front extension rod 6113 to secure the front extension rod 6113 to the drive member 62. Further, the transmission gears 6141 of the last gear holder 614 are meshed with the gear 211 at the first screw rod 21 (see FIGS. 5 and 7).

When the drive member 62 of the transmission mechanism 6 is rotated clockwise or counter-clockwise, the gears 633 of the front cover 63 are driven to rotate the driven gear 6111, causing the transmission gears 6112 to rotate the gear holders 612, 613 and 614, and therefore the transmission gears 6141 of the last gear holder 614 are forced to rotate the gear 211 and the first screw rod 21.

Figure 3:
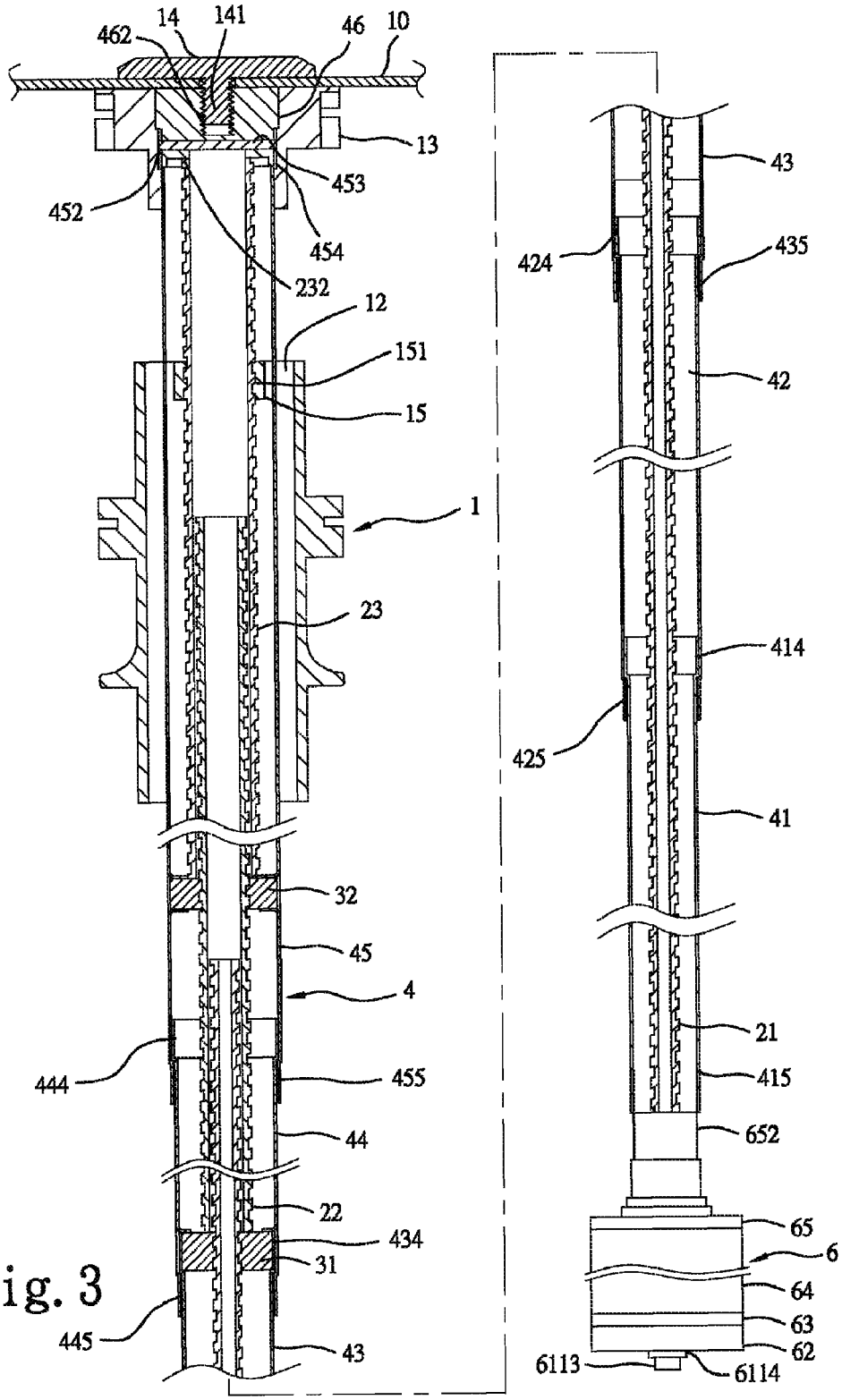
FIG. 3 is a schematic sectional view of the operating mechanism for umbrella in accordance with the first embodiment of the present invention.
Figure 4:
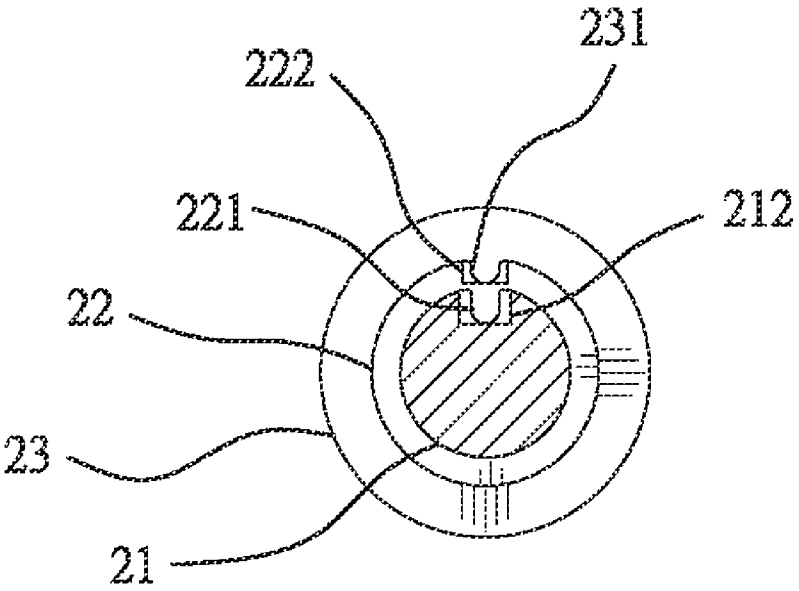
FIG. 4 is a cross sectional view of the present invention, showing the first screw rod, second screw rod and third screw rod concentrically coupled together.

Referring to FIG. 3, the tubular shaft elements 41~45 of the telescopic shaft 4 have different diameters. Further, each of the tubular shaft element 41~45 has a tubular shaft element body 415, 425, 435, 445 or 455, and a flange 414, 424, 434, 444 or 454 extending around the periphery of one end of the tubular shaft element body 415, 425, 435, 445 or 455. The tubular shaft elements 41~45 are axially inserted through one another, allowing the telescopic shaft 4 to be alternatively set between the extended position and the received position.

Figure 9:
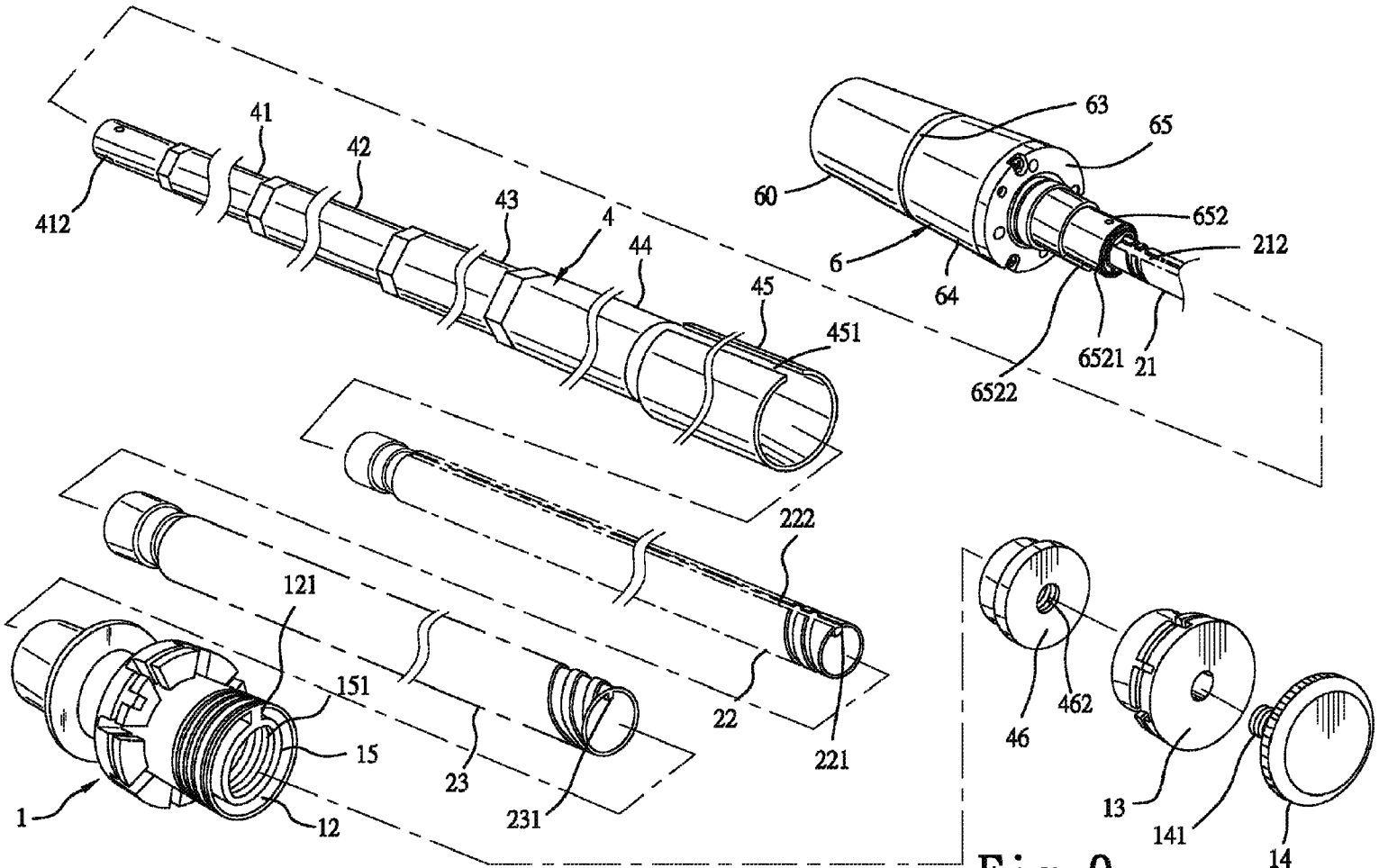
FIG. 9 is an exploded view of an operating mechanism for umbrella in accordance with a second embodiment of the present invention.
Figure 10:
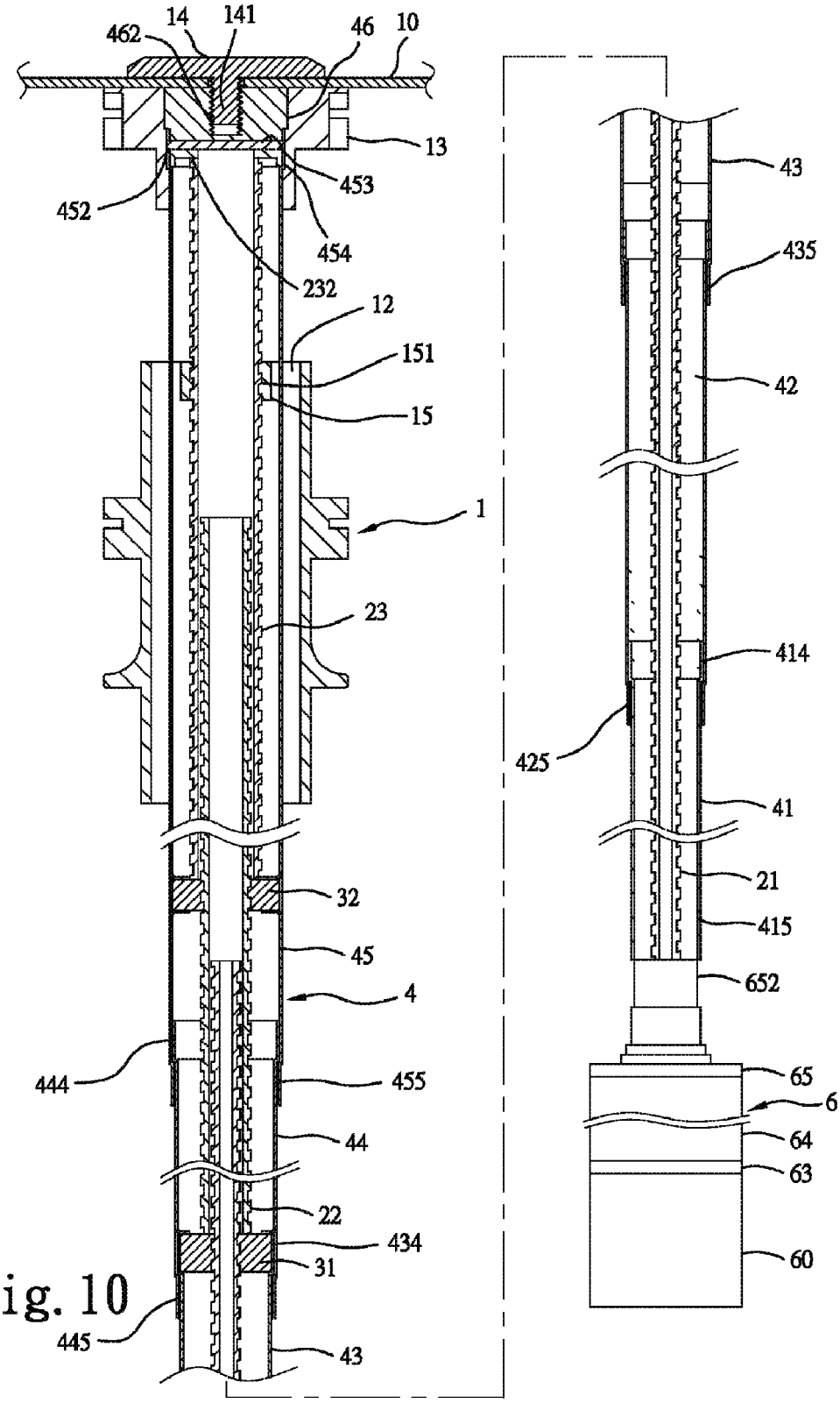
FIG. 10 is a schematic sectional view of the operating mechanism for umbrella in accordance with the second embodiment of the present invention.
Figure 11:
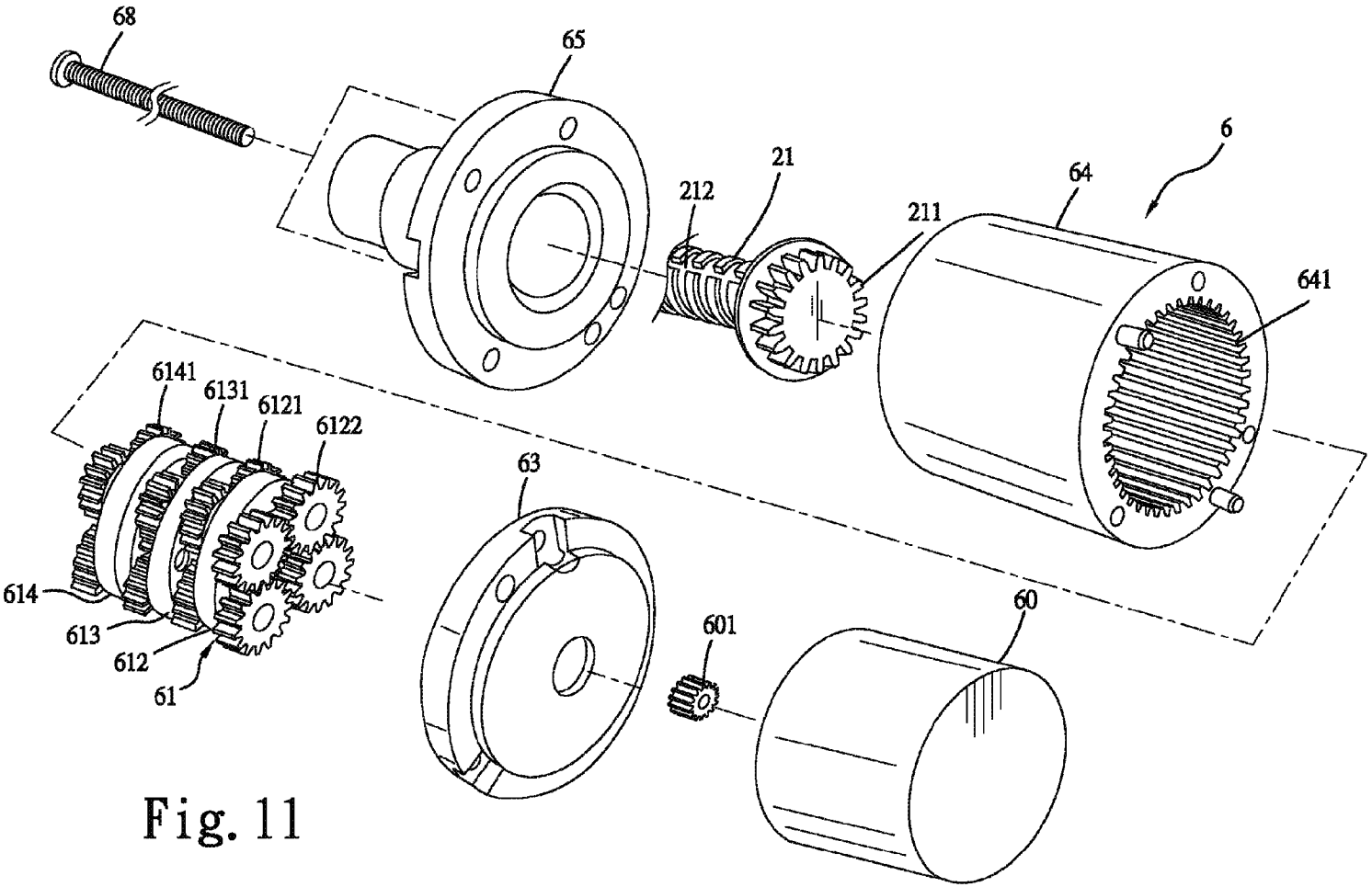
FIG. 11 is an exploded view of the transmission mechanism of the operating mechanism for umbrella in accordance with the second embodiment of the present invention.

FIGS. 9~11 show an operating mechanism in accordance with a second embodiment of the present invention. According to this second embodiment, a motor 60 is used to substitute for the aforesaid drive member 62 of the transmission mechanism 6. The motor 60 has a pinion 601 fixedly mounted on the output shaft (not shown) thereof. The transmission gear set 61 comprises a plurality of gear holders 612~614 each supporting a plurality of transmission gears 6121, 6131 and 6141. The gears 6121, 6131 and 6141 are meshed with the longitudinal teeth 641 of the housing 64. The gear holder 612 of the transmission gear set 61 further comprises a plurality of driven gear 6122 meshed with the pinion 601 of the motor 60. Further, the transmission gears 6141 of the last gear holder 614 are meshed with the gear 211 at the first screw rod 21. Further, the motor 60, front cover 63, housing 64 and rear cover 65 of the transmission mechanism 6 are fixedly fastened together with a screw rod 68. Further, a battery (not shown) is installed to provide the motor 60 with the necessary working voltage. The battery can be a regular battery or storage battery.

As indicated above, the invention has the following features and advantages:

1. By means of manually rotating the drive member 62 or by means of controlling the motor 60, the transmission mechanism 6 is driven to rotate the screw rods 21~23, causing the first screw nut 31 and the second screw nut 32 to move the telescopic shaft 4 and the third screw nut 15 to move the runner 1, and therefore the umbrella is opened or closed accurately. Because the screw rods 21~23 are disposed inside the telescopic shaft 4, they are kept from sight and well protected against outside dust.
2. When the screw rods 21~23 are rotated clockwise or counter-clockwise, the runner 1 is moved with the third screw nut 15 along the third screw rod 23 to close/open the umbrella. Therefore, a user can close/open the umbrella with less effort.
3. The invention assures high positioning stability and operation safety when closing/opening the umbrella.

4. The invention has high structural strength against wind force, assuring high durability for long service.
5. The operating mechanism is practical for use in a folding umbrella.

What is claimed is:

1. An operating mechanism used in an umbrella comprising a hub and rib assembly, a runner, a plurality of stretchers pivotally connected between ribs of said hub and rib assembly and said runner, and a canopy stretched on said hub and rib assembly, said operating mechanism being operable to move said runner against said stretchers to further force said ribs of said hub and rib assembly to open/close said canopy, said operating mechanism comprising a first screw rod, a second screw rod, a third screw rod, a first screw nut, a second screw nut, a third screw nut, a telescopic shaft and a transmission mechanism, wherein:

said first screw nut and said second screw nut are respectively fixedly mounted inside said telescopic shaft at different elevations;

said third screw nut is fixedly mounted in said runner;

said first screw rod is threaded through said first screw nut and inserted into said second screw rod, said first screw rod having a gear fixedly located on one end thereof and meshed with said transmission mechanism and a longitudinal sliding groove for guiding axial movement of said second screw rod relative to said first screw rod;

said second screw rod is threaded through said second screw nut, said second screw rod comprising a longitudinal sliding groove for guiding axial movement of said third screw rod relative to said second screw rod;

said third screw rod is threaded through said third screw nut, said third screw rod comprising a longitudinal rib axially slidably coupled to the longitudinal sliding groove of said second screw rod;

said telescopic shaft comprises a plurality of tubular shaft elements numbered from 1 through 5 and set to slide one inside another, the fifth tubular shaft element of said telescopic shaft being inserted through said runner;

said transmission mechanism is connected to one end of said first screw rod and operable to rotate said first screw rod.

2. The operating mechanism as claimed in claim 1, wherein said transmission mechanism comprises:

a housing, said housing being a tubular member comprising a plurality of longitudinal teeth arranged around an inside wall thereof;

a front cover fixedly mounted on a front side of said housing, said front cover comprising a center axle hole, a plurality of pivot pins perpendicularly extended from a front side thereof and equiangularly spaced around said center axle hole, and a plurality of gears respectively pivotally mounted on said pivot pins;

a rear cover fixedly mounted on a rear side of said housing, said rear cover comprising an extension tube sleeved onto said first screw rod, and a locating block fastened to the first tubular shaft element of said telescopic shaft;

a transmission gear set, said transmission gear set comprising a plurality of gear holders, multiple sets of transmission gears mounted on said gear holders and meshed with the longitudinal teeth of said housing, a first gear holder of said gear holders of said transmission gear set comprising an axle pivotally coupled to the center axle hole of said front cover, and a driven gear fixedly mounted on a distal end of said axle and meshed with the gears of said front cover, the transmission gears of a last gear holder of said gear holders of said transmission gear set being meshed with the gear at said first screw rod; and a drive member operable to rotate said transmission gear set, said drive member comprising a circular chamber and a plurality of teeth arranged in said circular chamber and meshed with the gears of said front cover.

3. The operating mechanism as claimed in claim 2, wherein said transmission gear set further comprises a front extension rod axially extended from said driven gear and inserted through said drive member, and a retainer ring fastened to a locating groove around the periphery of said front extension rod to secure said front extension rod to said drive member.

4. The operating mechanism as claimed in claim 1, wherein said tubular shaft elements of said telescopic shaft have different diameters, each said tubular shaft element comprising a tubular shaft element body and a flange extending around the periphery of one end of the tubular shaft element body, said tubular shaft elements being axially inserted through one another for allowing said telescopic shaft to be alternatively set between an extended position and a received position.

5. The operating mechanism as claimed in claim 1, wherein the fifth tubular shaft element of said telescopic shaft comprises a longitudinal crevice, which receives a longitudinal rib of said runner.

6. The operating mechanism as claimed in claim 1, wherein said telescopic shaft further comprises a cap affixed to a top end of said fifth tubular shaft element for stopping a top end of said third screw rod, said cap comprising a top screw hole, and a holding down device attached to a top side of said canopy to hold down said canopy on said cap and said hub and rib assembly, said holding down device comprising a threaded shank threaded into the top screw hole of said cap.

7. The operating mechanism as claimed in claim 1, wherein transmission mechanism comprises:

a housing, said housing being a tubular member comprising a plurality of longitudinal teeth arranged around an inside wall thereof;

a front cover fixedly mounted on a front side of said housing;

a rear cover fixedly mounted on a rear side of said housing, said rear cover comprising an extension tube sleeved onto said first screw rod, and a locating block fastened to the first tubular shaft element of said telescopic shaft;

a transmission gear set, said transmission gear set comprising a plurality of gear holders, multiple sets of transmission gears mounted on said gear holders and meshed with the longitudinal teeth of said housing, the transmission gears at a last gear holder of said gear holders of said transmission gear set being meshed with the gear at said first screw rod; and a motor affixed to said front cover and operable to rotate said transmission gear set, said motor comprising a pinion meshed with a first set of transmission gears of said transmission gear set.

* * * * *